US010920715B2

(12) United States Patent
Koo

(10) Patent No.: US 10,920,715 B2
(45) Date of Patent: Feb. 16, 2021

(54) EVAPORATION GAS CONTROL SYSTEM AND FAULT DIAGNOSIS METHOD THEREOF

(71) Applicants: HYUNDAI MOTOR COMPANY, Seoul (KR); KIA MOTORS CORPORATION, Seoul (KR)

(72) Inventor: Bon Chang Koo, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 93 days.

(21) Appl. No.: 16/425,183

(22) Filed: May 29, 2019

(65) Prior Publication Data

US 2020/0191099 A1 Jun. 18, 2020

(30) Foreign Application Priority Data

Dec. 12, 2018 (KR) ..... 10-2018-0159727

(51) Int. Cl.
*F02M 25/08* (2006.01)
*F02D 41/00* (2006.01)

(52) U.S. Cl.
CPC ..... *F02M 25/0836* (2013.01); *F02D 41/0037* (2013.01); *F02D 41/0097* (2013.01); *F02M 25/0809* (2013.01)

(58) Field of Classification Search
CPC ..... F02M 25/0836; F02M 25/0809; F02D 41/0097; F02D 41/0037
See application file for complete search history.

(56) References Cited

U.S. PATENT DOCUMENTS

| | | | | |
|---|---|---|---|---|
| 2014/0026867 | A1* | 1/2014 | Itoh | F02M 25/0809 123/520 |
| 2014/0283795 | A1* | 9/2014 | Kimura | F02M 25/0809 123/520 |
| 2018/0187614 | A1* | 7/2018 | Dudar | F02M 25/0827 |
| 2020/0003164 | A1* | 1/2020 | Choi | F02M 35/10222 |
| 2020/0116108 | A1* | 4/2020 | Akita | F02D 41/004 |

* cited by examiner

*Primary Examiner* — Sizo B Vilakazi
(74) *Attorney, Agent, or Firm* — Brinks Gilson & Lione

(57) ABSTRACT

An evaporation gas control system includes: a canister that traps evaporation gas generated in a fuel tank, a fuel tank pressure sensor that measures pressure in the fuel tank, a purge control valve that controls a flow of the evaporation gas, which is trapped in the canister, into a surge tank through a purge line, a charger that supplies intake air from the outside into the surge tank, a check valve installed on the purge line to prevent the evaporation gas in the purge line from flowing back to the canister, and a controller that diagnoses whether the check valve is faulty or not, by monitoring a pressure variation in the fuel tank when the charger and the purge control valve operate.

15 Claims, 6 Drawing Sheets

EVAPORATION GAS CONTROL SYSTEM AND FAULT DIAGNOSIS METHOD THEREOF

CROSS-REFERENCE TO RELATED APPLICATION

This application claims priority to and the benefit of Korean Patent Application No. 10-2018-0159727, filed on Dec. 12, 2018, the entire contents of which are incorporated herein by reference.

FIELD

The present disclosure relates to an evaporation gas control system and a fault diagnosis method thereof.

BACKGROUND

The statements in this section merely provide background information related to the present disclosure and may not constitute prior art.

A purge control solenoid valve (PCSV) selectively introduces fuel evaporation gas trapped in a canister into a surge tank through a purge line. In the case of a turbo engine, the purge control solenoid valve is connected with an intake line at the front end of a compressor of a turbo charger, and a check valve is installed on the purge line to prevent the fuel evaporation gas in the purge line from flowing backward when the turbo charger operates.

In the case of a conventional gasoline direct injection (GDI) engine, backflow from an intake line to a purge line does not occur because there is no boosting area. In contrast, in the case of the turbo engine, backflow occurs during boosting, and therefore the check valve is installed to prevent the backflow. When the check valve does not operate normally, backflow may occur through the purge line, causing damage to the canister and the fuel tank. However, in the related art, there is no way of performing a fault diagnosis for a check valve stuck-open state.

SUMMARY

An aspect of the present disclosure provides an evaporation gas control system and a fault diagnosis method thereof for determining whether a check valve on a purge line is faulty or not, by monitoring a pressure variation in a fuel tank.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an evaporation gas control system includes: a canister that traps evaporation gas generated in a fuel tank, a fuel tank pressure sensor that measures pressure in the fuel tank, a purge control valve that controls a flow of the evaporation gas, which is trapped in the canister, into a surge tank through a purge line, a charger that supplies intake air from the outside into the surge tank, a check valve installed on the purge line to prevent the evaporation gas in the purge line from flowing back to the canister, and a controller that diagnoses whether the check valve is faulty or not, by monitoring a pressure variation in the fuel tank when the charger and the purge control valve operate.

The evaporation gas control system may further include a vehicle speed sensor that measures vehicle speed. The controller may perform the fault diagnosis of the check valve when an engine load which varies depending on the vehicle speed and travel time of the vehicle satisfies a condition for entrance to a diagnostic mode.

The controller may calculate a rate of change of pressure in the fuel tank for a period of time during which the purge control valve is open.

The evaporation gas control system may further include a fuel level sensor that measures a fuel level in the fuel tank and a temperature sensor that measures temperature of the intake air suctioned by the charger. The controller may calculate a threshold based on the fuel level and the temperature of the intake air.

The controller may determine that the check valve is in a normal state, when the rate of change of pressure in the fuel tank is less than the threshold.

The controller may determine that the check valve is faulty, when the rate of change of pressure in the fuel tank is equal to or greater than the threshold.

The controller may diagnose that the check valve is stuck in an open position, when the rate of change of pressure in the fuel tank is equal to or greater than the threshold.

According to another aspect of the present disclosure, a fault diagnosis method of an evaporation gas control system includes: determining, by a controller, entering a diagnostic mode, based on an engine load of a vehicle; monitoring, by the controller, a pressure variation in a fuel tank when a charger and a purge control valve operate after entering the diagnostic mode; and diagnosing, by the controller, whether a check valve is faulty or not, based on the pressure variation in the fuel tank.

The method further may include determining, by the controller at a time of entering to the diagnostic mode, whether an engine of the vehicle is warmed up, based on vehicle speed and travel time of the vehicle.

The step of monitoring the pressure variation in the fuel tank may include: a step of determining whether an operating condition of the charger is satisfied, a step of determining whether the purge control valve is open, and a step of measuring pressure in the fuel tank, a fuel level, and intake air temperature, while the purge control valve is open.

The step of determining whether the operating condition of the charger is satisfied may include a step of determining whether coolant temperature measured by a temperature sensor reaches a target temperature.

The step of diagnosing whether the check valve is faulty or not may include: a step of calculating a threshold based on the fuel level and the intake air temperature, a step of calculating a rate of change of pressure in the fuel tank, and comparing the rate of change of pressure with the threshold.

The step of determining whether the check valve is faulty or not may include a step of determining that the check valve is in a normal state, when the rate of change of pressure is less than the threshold.

The step of determining whether the check valve is faulty or not may include a step of determining that the check valve is faulty, when the rate of change of pressure is equal to or greater than the threshold.

The step of determining whether the check valve is faulty or not may further include a step of diagnosing that the check valve is stuck in an open position, when the rate of change of pressure is equal to or greater than the threshold.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
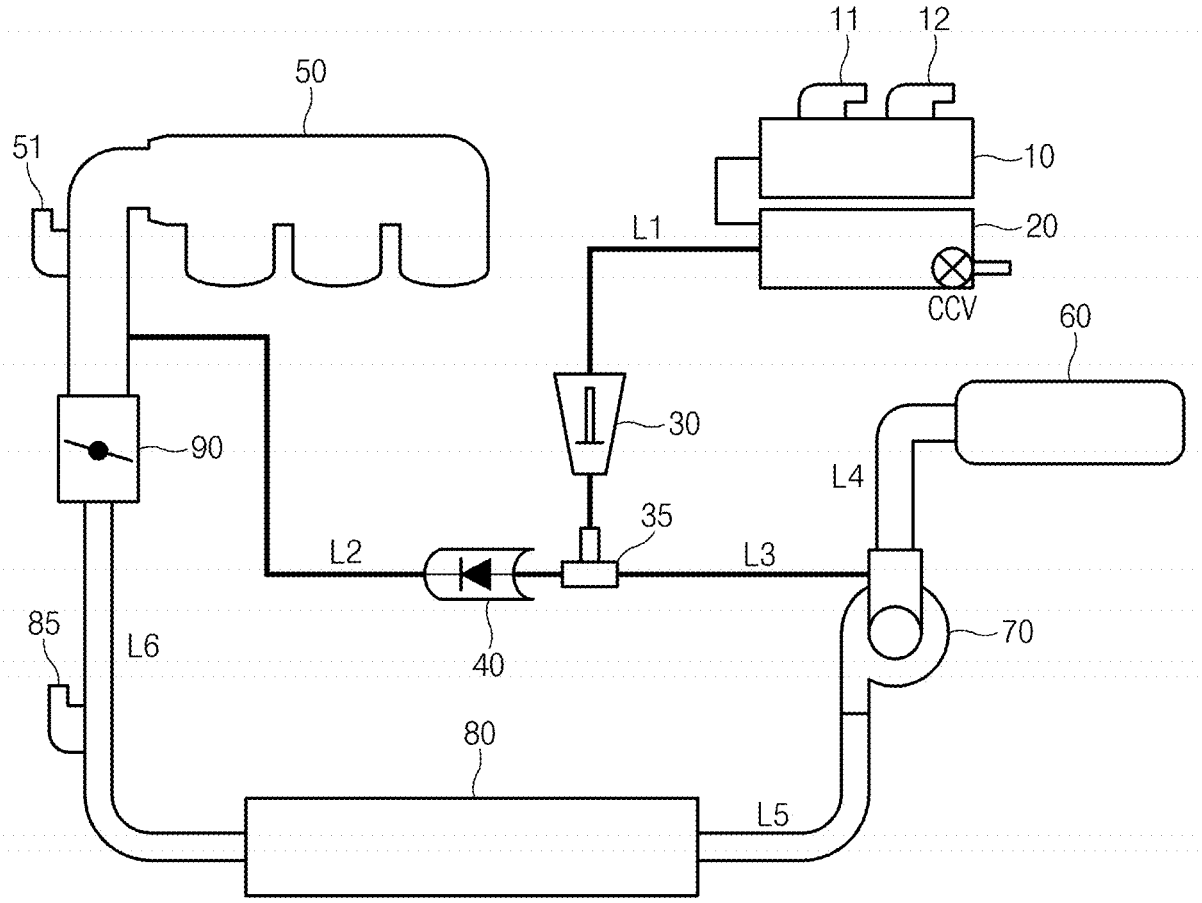
FIG. 1 is a view illustrating a configuration of an evaporation gas purge system according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Further, in describing exemplary forms of the present disclosure, a detailed description of well-known features or functions will be ruled out in order not to unnecessarily obscure the gist of the present disclosure.

In describing the components of the forms according to the present disclosure, terms such as first, second, "A", "B", (a), (b), and the like may be used. These terms are merely intended to distinguish one component from another component, and the terms do not limit the nature, sequence or order of the constituent components. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

The present disclosure is based on the feature that pressure in a fuel tank remains constant when a check valve is stuck open. The present disclosure monitors a pressure variation in a fuel tank to determine whether a check valve on a purge line is faulty or not, thereby determining whether an evaporation gas control system is abnormal or not. Here, the evaporation gas control system prevents fuel evaporation gas (hydrocarbon (HC)) generated in the fuel tank from being released into the atmosphere.

The present disclosure discloses a technology for diagnosing whether a check valve is stuck open, by monitoring a pressure variation in a fuel tank, with a purge control solenoid valve open for a short time, so as to determine whether the check valve, which is installed on a purge line in a boosting area in which a turbo charger operates, is normal or not after an engine is warmed up and coolant temperature reaches a target temperature.

FIG. 1 is a view illustrating a configuration of an evaporation gas purge system according to one form of the present disclosure.

Referring to FIG. 1, the evaporation gas purge system includes a fuel tank 10, a canister 20, a purge control valve 30, a check valve 40, a surge tank 50, an air cleaner 60, a compressor 70, an inter-cooler 80, and a throttle valve 90.

The fuel tank 10 is a reservoir in which fuel is stored. Fuel vapor, that is, fuel evaporation gas (hydrocarbon (HC)) is generated in the fuel tank 10. The fuel evaporation gas (hereinafter, referred to as the evaporation gas) is introduced into the canister 20 during an engine stop. The fuel tank 10 has a fuel level sensor 11 and a fuel tank pressure sensor (FTPS) 12 mounted thereto. The fuel level sensor 11 measures the fuel level (the remaining amount of fuel), and the FTPS 12 measures the pressure in the fuel tank 10.

The canister 20 traps the evaporation gas generated in the fuel tank 10, while the engine is stopped. The canister 20 has activated-carbon therein. The canister 20 has an air inlet connected thereto, through which the air flows into the canister 20, and a canister control valve (CCV) is mounted to the air inlet. Opening/closing the CCV is controlled by a controller 140 that will be described below. When the engine starts, the controller 140 opens the CCV to cause the air to flow into the canister 20. The air introduced into the canister 20 is mixed with the evaporation gas.

The purge control valve 30 is installed on a main purge line L1 connected to the canister 20 and selectively blocks the evaporation gas trapped by the canister 20. The purge control valve 30 may be implemented with a purge control solenoid valve (PCSV).

The main purge line L1 branches into a first purge line L2 and a second purge line L3 through a distributor 35. The purge control valve 30 is connected with the surge tank 50 through the first purge line L2. The purge control valve 30 is connected with the front end of the compressor 70 through the second purge line L3.

The check valve 40 is installed on the first purge line L2 to prevent the evaporation gas in the first purge line L2 from flowing back to the canister 20 when a charger operates. That is, the check valve 40 blocks backflow of the evaporation gas through the first purge line L2. Furthermore, the check valve 40 may prevent air from flowing backward in a boosting area.

The surge tank 50 is a space located between the throttle valve 90 and an intake manifold to temporarily store air introduced through intake lines L4 to L6. The surge tank 50 supplies intake air into cylinders of the engine through the intake manifold. A manifold absolute pressure (MAP) sensor 51 is installed at the front end of the surge tank 50. The MAP sensor 51 is a sensor for sensing the pressure of air introduced into the engine, that is, the intake air pressure. The controller 140 may detect a pressure variation in the intake manifold through the map sensor 51 to determine the load state of the engine and indirectly measure the amount of intake air.

The air cleaner 60, the compressor 70, the inter-cooler 80, and the throttle valve 90 are installed on the intake lines L4 and L6.

The air cleaner 60 removes (filters) foreign matter such as dust contained in air introduced from the outside. The air cleaner 60 supplies the filtered air into the compressor 70.

An air flow sensor (AFS) for measuring the amount of air suctioned into the air cleaner 60 is installed in the vicinity of the air cleaner 60.

The compressor 70, which is a part of a turbo charger, compresses filtered intake air supplied through the air cleaner 60. Here, the turbo charger includes a turbine that is rotated by exhaust gas discharged from the engine and the compressor 70 that is rotated by the turbine to compress intake air that is supplied into the engine.

The inter-cooler 80 is an apparatus for cooling high-temperature compressed air that is compressed by the compressor 70. That is, the inter-cooler 80 cools intake air compressed by the compressor 70 and hence raises the density of the air.

The throttle valve 90 adjusts the amount of intake air that is supplied into the engine. The duty of the throttle valve 90 is controlled by the controller 140 that will be described below.

A boost sensor 85 is installed on the intake line L6 that connects the inter-cooler 80 and the throttle valve 90. The boost sensor 85 measures boost pressure supplied into the intake manifold by the compressor 70.

Figure 2:
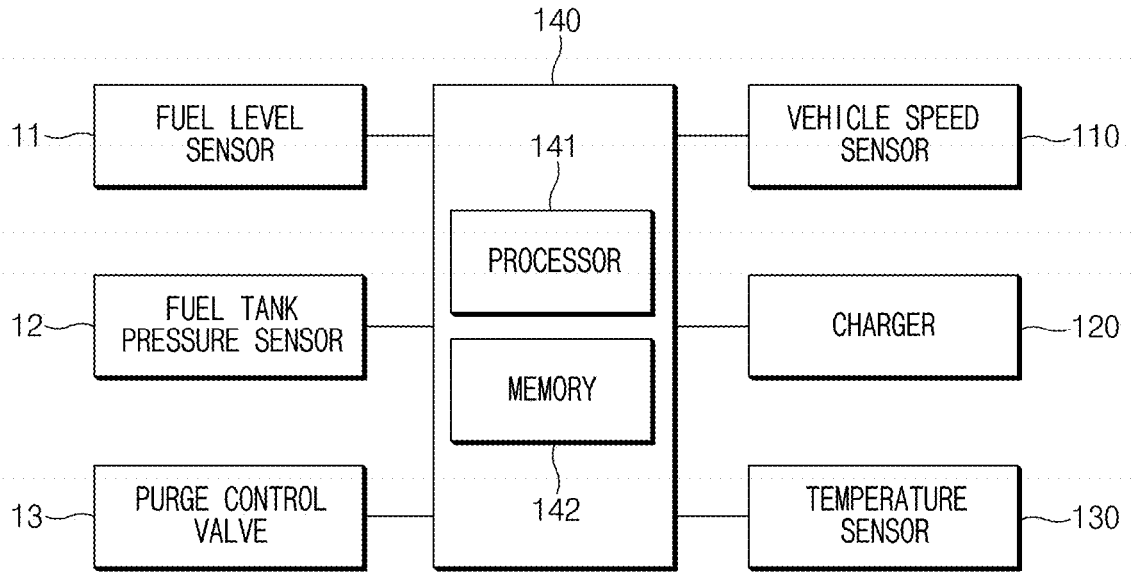
FIG. 2 is a block diagram illustrating an evaporation gas control system according to one form of the present disclosure.
Figure 3:
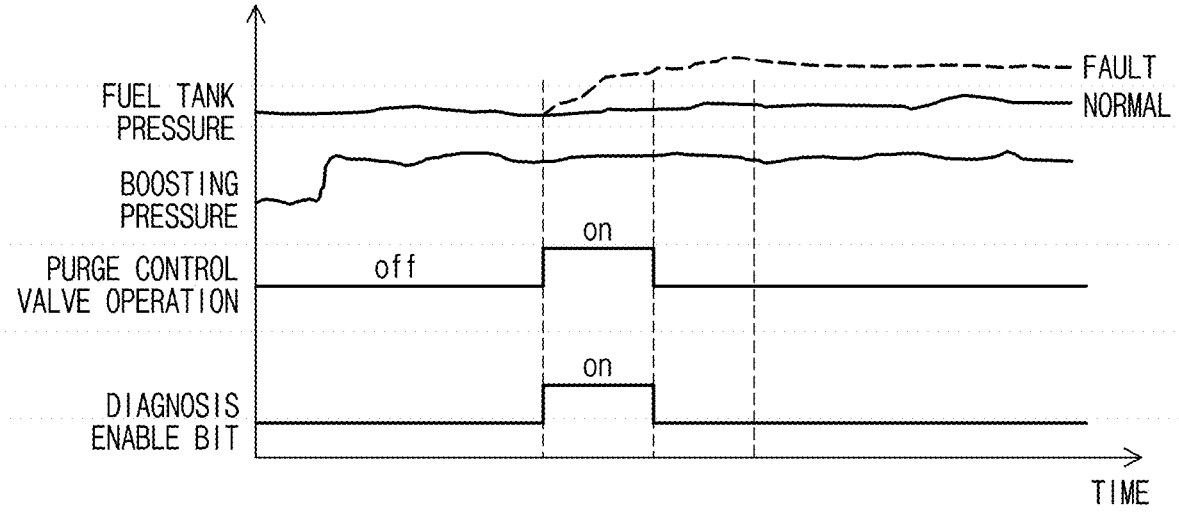
FIGS. 3 and 4 are views illustrating a check valve fault diagnosis method according to one form of the present disclosure.
Figure 4:
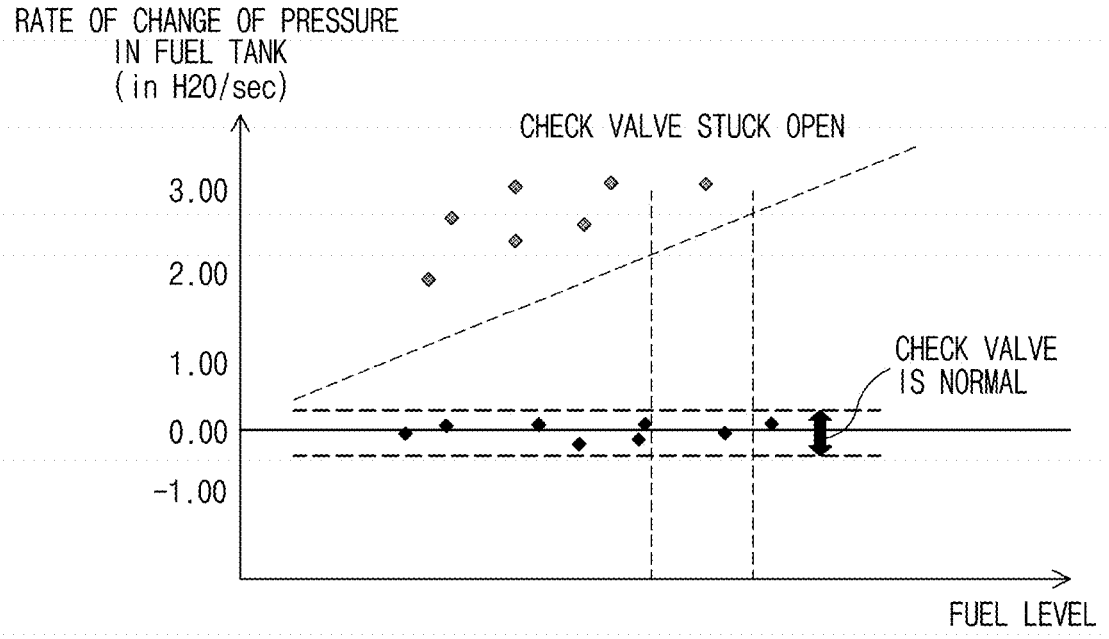

FIG. 2 is a block diagram illustrating an evaporation gas control system according to one form of the present disclosure, and FIGS. 3 and 4 are views illustrating a check valve fault diagnosis method according to another form of the present disclosure.

Referring to FIG. 2, the evaporation gas control system includes the fuel level sensor 11, the fuel tank pressure sensor (FTPS) 12, the purge control valve 30, a vehicle speed sensor (VSS) 110, a charger 120, a temperature sensor 130, and the controller 140.

The fuel level sensor 11 measures the fuel level in the fuel tank 10. The FTPS 12 measures the pressure in the fuel tank 10.

The purge control valve 30 is installed on the main purge line L1 connected to the canister 20. When the purge control valve 30 is opened, evaporation gas trapped in the canister 20 flows into the surge tank 50. Meanwhile, when the purge control valve 30 is closed, the flow of the evaporation gas into the surge tank 50 is blocked. The controller 140 opens the purge control valve 30 to remove (purge) evaporation gas trapped in the canister 20 while the engine operates.

The VSS 110 is a sensor for measuring the speed of a vehicle. The VSS 110 may be implemented with at least one of a reed-switch type vehicle speed sensor, a photoelectric vehicle speed sensor, an electronic vehicle speed sensor, a voltage detection type vehicle speed sensor, a cycle detection type vehicle speed sensor, a motor position sensor, and the like.

The charger 120 supplies intake air from the outside into the engine. The charger 120 is a turbo charger that includes a turbine that is rotated by exhaust gas discharged from the engine and the compressor 70 that is rotated by the turbine to compress intake air that is supplied into the engine.

The temperature sensor 130 may measure intake air temperature, coolant temperature, and the like. That is, the temperature sensor 130 may include an air temperature sensor, a water temperature sensor (WTS), and the like. The air temperature sensor is attached to the AFS, which is installed in the vicinity of the air cleaner 60, to sense the temperature of intake air. The air temperature sensor may be implemented with a thermistor. The water temperature sensor is installed in a coolant passage of the intake manifold to measure the temperature of engine coolant. A bimetal, a thermistor, or the like may be used as the water temperature sensor.

The controller 140 includes a processor 141 that controls an overall operation of the evaporation gas control system and a memory 142 that stores a program for an operation of the processor 141. The processor 141 may be implemented with at least one of an application specific integrated circuit (ASIC), a digital signal processor (DSP), programmable logic devices (PLDs), field programmable gate arrays (FPGAs), a central processing unit (CPU), microcontrollers, and microprocessors. The memory 142 may be implemented with at least storage medium (recording medium) among storage mediums such a flash memory, a hard disk, a secure digital (SD) card, a random access memory (RAM), a static random access memory (SRAM), a read only memory (ROM), a programmable read only memory (PROM), an electrically erasable and programmable ROM (EEPROM), an erasable and programmable ROM (EPROM), a register, and the like.

The controller 140 determines whether an engine load satisfies a condition for entering a diagnostic mode. In this case, the controller 140 determines whether the engine is warmed up, based on vehicle speed and travel time. For example, the controller 140 determines whether the vehicle has travelled for 60 seconds or more at 20 km/h or more, by using the vehicle speed sensor 110.

When the engine load satisfies the condition for entering the diagnostic mode, the controller 140 performs the diagnostic mode. Thereafter, the controller 140 determines whether an operating condition of the charger 120 is satisfied. When coolant temperature reaches a target temperature, the controller 140 operates the charger 120.

When the operating condition of the charger 120 is satisfied, the controller 140 determines whether the purge control valve 30 operates. The controller 140 opens the purge control valve 30 for a preset period of time to determine whether the check valve 40 is normal or not in the boosting area in which the charger 120 operates.

Referring to FIG. 3, the controller 140 performs a check valve fault diagnosis (diagnosis enable bit: on) when the charger 120 operates to form boosting pressure and the purge control valve 30 operates to open the purge line.

The controller 140 monitors a pressure variation in the fuel tank 10 through the FTPS 12, while the purge control valve 30 is open. In other words, the controller 140 measures (calculates) the rate of change of pressure (pressure variation rate) in the fuel tank 10 for each hour.

The controller 140 calculates a threshold in view of the fuel level measured by the fuel level sensor 11 and the intake air temperature measured by the temperature sensor. In this case, the controller 140 may determine the threshold with reference to a lookup table stored in the memory 142 in advance, in which thresholds depending on fuel levels and intake air temperatures are defined. When the rate of change of pressure in the fuel tank 10 is less than the threshold, the controller 140 determines that the check valve 40 is normal. In contrast, when the rate of change of pressure in the fuel tank 10 is not less than the threshold (i.e., equal to or greater than the threshold value), the controller 140 determines that the check valve 40 is stuck in an open position. That is, the check valve is faulty and does not properly operate. In this case, when the rate of change of pressure remains at the threshold or more for a predetermined period of time, the controller 140 determines that the check valve 40 is faulty.

Referring to FIG. 4, when the rate of change of pressure in the fuel tank 10, that is, the pressure deviation is within a threshold range, the controller 140 determines that the check valve 40 is normal. In contrast, when the rate of change of pressure in the fuel tank 10 is beyond the threshold range, the controller 140 recognizes that the check valve 40 is stuck in the open position and determines that the check valve 40 is faulty.

Figure 5:
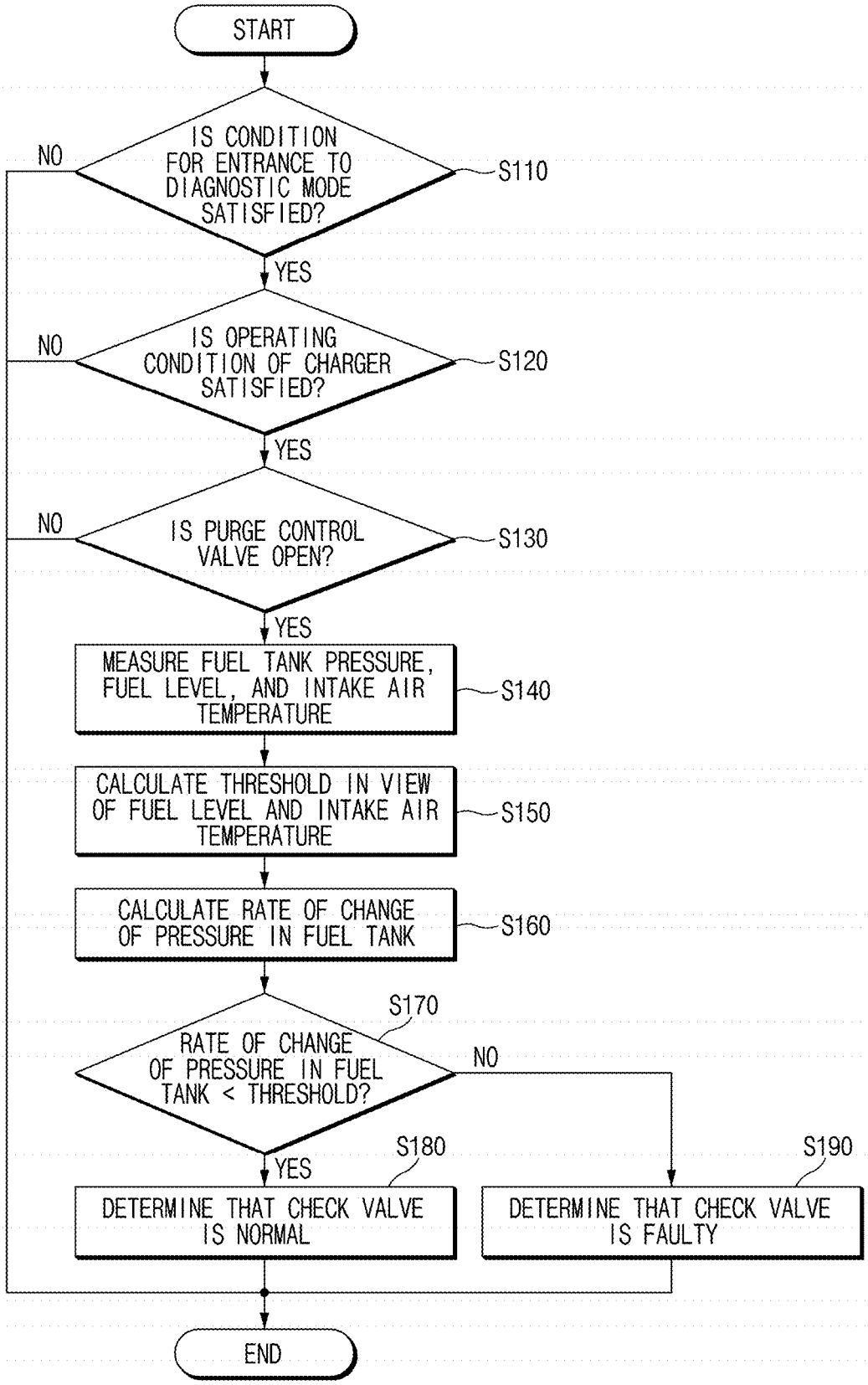
FIG. 5 is a flowchart illustrating a fault diagnosis method of the evaporation gas control system according to one form of the present disclosure.

FIG. 5 is a flowchart illustrating a fault diagnosis method of the evaporation gas control system according to one form of the present disclosure.

Referring to FIG. 5, the controller 140 of the evaporation gas control system determines whether an engine load which varies depending on vehicle speed and travel time satisfies a condition for entering a diagnostic mode (S110). The controller 140 determines whether the vehicle has travelled for 60 seconds or more at 20 km/h or more, through the vehicle speed sensor 110 and determines whether the condition for entering the diagnostic mode is satisfied, based on the determination result. When it is determined that the vehicle has travelled for 60 seconds or more at 20 km/h or more, the controller 140 performs the diagnostic mode for a fault diagnosis of the check valve 40.

After the entrance to the diagnostic mode, the controller 140 determines whether an operating condition of the charger 120 is satisfied (S120). That is, when coolant temperature reaches a target temperature, the controller 140 operates the charger 120 to form boosting pressure. When the coolant temperature does not reach the target temperature, the controller 140 does not operate the charger 120.

The controller 140, when operating the charger 120, determines whether the purge control valve 30 is open (S130). The controller 140 may control the purge control valve 30 for a preset period of time to open the purge line.

When the purge control valve 30 is open, the controller 140 measures the pressure in the fuel tank 10, the fuel level, and the temperature of intake air (S140). In this case, the controller 140 monitors a pressure variation in the fuel tank 10 for a period of time during which the purge control valve 30 is open.

The controller 140 calculates a threshold in view of the fuel level and the intake air temperature (S150). The threshold is used as a criterion for determining whether the check valve 40 is faulty or not.

The controller 140 calculates the rate of change of pressure, based on the measured pressure of the fuel tank 10 (S160). That is, the controller 140 calculates the pressure deviation of the fuel tank 10.

The controller 140 determines whether the rate of change of pressure in the fuel tank 10 is less than the threshold (S170).

When the rate of change of pressure in the fuel tank 10 is less than the threshold, the controller 140 determines that the check valve 40 is in a normal state (S180).

In contrast, when the rate of change of pressure in the fuel tank 10 is not less than the threshold, the controller 140 determines that the check valve 40 is faulty (S190). In other words, when the pressure deviation of the fuel tank 10 is not less than the threshold, the controller 140 determines that the check valve 40 is stuck open.

Figure 6:
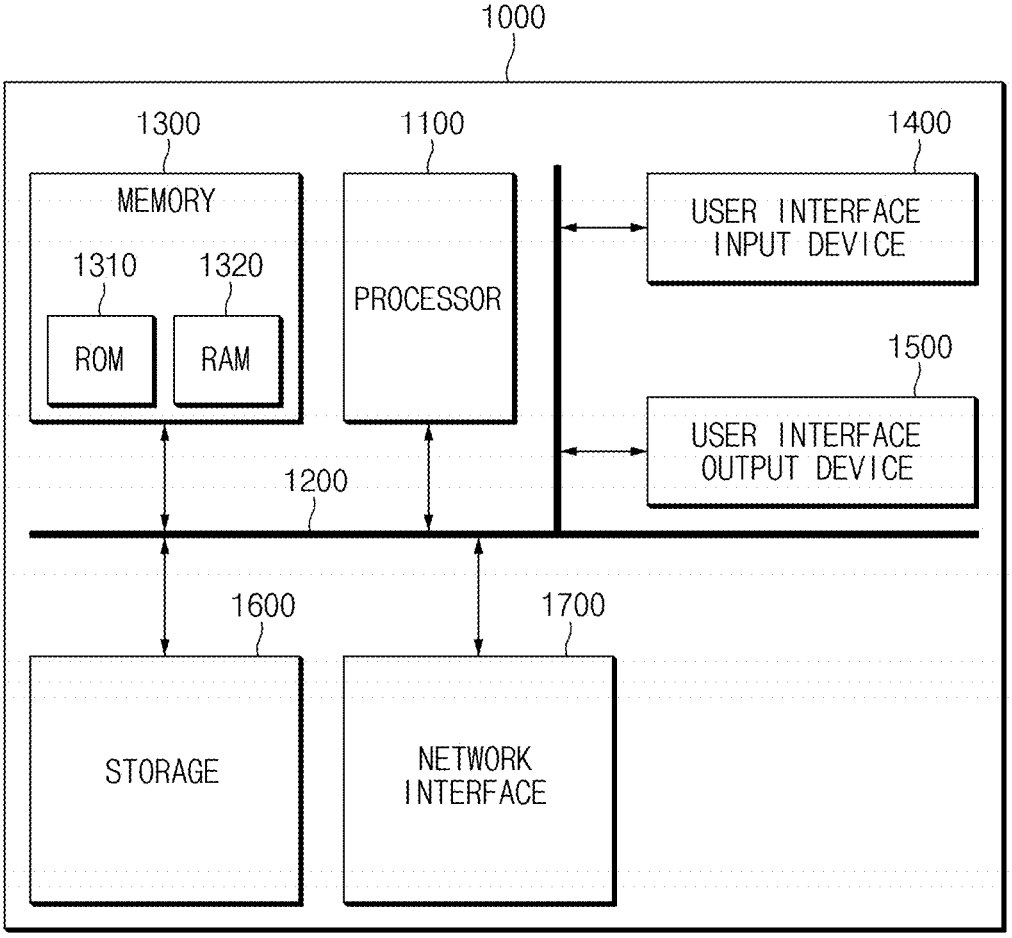
FIG. 6 is a block diagram illustrating a computing system for executing the fault diagnosis method of the evaporation gas control system according to one form of the present disclosure.

FIG. 6 is a block diagram illustrating a computing system for executing the fault diagnosis method of the evaporation gas control system according to another form of the present disclosure.

Referring to FIG. 6, the computing system 1000 may include at least one processor 1100, a memory 1300, a user interface input device 1400, a user interface output device 1500, storage 1600, and a network interface 1700, which are connected with each other via a bus 1200.

The processor 1100 may be a central processing unit (CPU) or a semiconductor device that processes instructions stored in the memory 1300 and/or the storage 1600. The memory 1300 and the storage 1600 may include various types of volatile or non-volatile storage media. For example, the memory 1300 may include a ROM (Read Only Memory) 1310 and a RAM (Random Access Memory) 1320.

Thus, the operations of the method or the algorithm described in connection with the forms disclosed herein may be embodied directly in hardware or a software module executed by the processor 1100, or in a combination thereof. The software module may reside on a storage medium (that is, the memory 1300 and/or the storage 1600) such as a RAM memory, a flash memory, a ROM memory, an EPROM memory, an EEPROM memory, a register, a hard disk, a removable disk, or a CD-ROM. The exemplary storage medium may be coupled to the processor 1100, and the processor 1100 may read information out of the storage medium and may record information in the storage medium. Alternatively, the storage medium may be integrated with the processor 1100. The processor 1100 and the storage medium may reside in an application specific integrated circuit (ASIC). The ASIC may reside within a user terminal. In another case, the processor 1100 and the storage medium may reside in the user terminal as separate components.

According to the present disclosure, the evaporation gas control system and the fault diagnosis method thereof monitor the pressure variation in the fuel tank to determine whether the check valve on the purge line is faulty or not, thereby diagnosing a fault caused by check valve stuck open.

Hereinabove, although the present disclosure has been described with reference to exemplary forms and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary forms of the present disclosure are provided to explain the spirit and scope of the present disclosure, but not to limit them, so that the spirit and scope of the present disclosure is not limited by the forms.

What is claimed is:

1. An evaporation gas control system comprising:

a canister configured to trap evaporation gas generated in a fuel tank;

a fuel tank pressure sensor configured to measure pressure in the fuel tank;

a purge control valve configured to control a flow of the evaporation gas, which is trapped in the canister, into a surge tank through a purge line;

a charger configured to supply intake air from outside into the surge tank;

a check valve installed on the purge line to prevent the evaporation gas in the purge line from flowing back to the canister; and a controller configured to diagnose whether the check valve is faulty or not, by monitoring a pressure variation in the fuel tank when the charger and the purge control valve operate.

2. The evaporation gas control system of claim 1, further comprising:

a vehicle speed sensor configured to measure a speed of a vehicle, wherein the controller is configured to perform the fault diagnosis of the check valve when an engine load which varies depending on the speed of the vehicle and a travel time of the vehicle satisfies a condition for entrance to a diagnostic mode.

3. The evaporation gas control system of claim 1, wherein the controller is configured to calculate a rate of change of pressure in the fuel tank during the purge control valve is open.

4. The evaporation gas control system of claim 3, further comprising:

a fuel level sensor configured to measure a fuel level in the fuel tank; and a temperature sensor configured to measure temperature of the intake air suctioned by the charger, wherein the controller is configured to calculate a threshold based on the fuel level and the temperature of the intake air.

5. The evaporation gas control system of claim 4, wherein the controller is configured to determine that the check valve is in a normal state, when the rate of change of pressure in the fuel tank is less than the threshold.

6. The evaporation gas control system of claim 4, wherein the controller is configured to determine that the check valve is faulty, when the rate of change of pressure in the fuel tank is equal to or greater than the threshold.

7. The evaporation gas control system of claim 6, wherein the controller is configured to diagnose that the check valve is stuck in an open position, when the rate of change of pressure in the fuel tank is equal to or greater than the threshold.

8. A fault diagnosis method of an evaporation gas control system, the method comprising:

determining, by a controller, entering a diagnostic mode, based on an engine load of a vehicle;

monitoring, by the controller, a pressure variation in a fuel tank when a charger and a purge control valve operate after entering the diagnostic mode; and diagnosing, by the controller, whether a check valve is faulty or not, based on the pressure variation in the fuel tank.

9. The fault diagnosis method of claim 8, further comprising:

determining, by the controller at a time of entering to the diagnostic mode, whether an engine of the vehicle is warmed up based on a speed of the vehicle and a travel time of the vehicle.

10. The fault diagnosis method of claim 8, wherein monitoring the pressure variation in the fuel tank includes:

determining whether an operating condition of the charger is satisfied;

determining whether the purge control valve is open; and measuring a pressure in the fuel tank, a fuel level, and intake air temperature, while the purge control valve is open.

11. The fault diagnosis method of claim 10, wherein determining whether the operating condition of the charger is satisfied includes determining whether a coolant temperature measured by a temperature sensor reaches a target temperature.

12. The fault diagnosis method of claim 10, wherein diagnosing whether the check valve is faulty or not includes:

calculating a threshold based on the fuel level and the intake air temperature;

calculating a rate of change of pressure in the fuel tank; and comparing the rate of change of pressure with the threshold.

13. The fault diagnosis method of claim 12, wherein determining whether the check valve is faulty or not includes determining that the check valve is in a normal state, when the rate of change of pressure is less than the threshold.

14. The fault diagnosis method of claim 12, wherein determining whether the check valve is faulty or not includes determining that the check valve is faulty, when the rate of change of pressure is equal to or greater than the threshold.

15. The fault diagnosis method of claim 14, wherein determining whether the check valve is faulty or not further includes diagnosing that the check valve is stuck in an open position, when the rate of change of pressure is equal to or greater than the threshold.

* * * * *